United States Patent [19]

Betts

[11] Patent Number: 4,892,037

[45] Date of Patent: Jan. 9, 1990

[54] SELF CONSUMABLE INITIATOR

[75] Inventor: Robert E. Betts, Huntsville, Ala.

[73] Assignee: The United States of America as represented by the Secretary of the Army, Washington, D.C.

[21] Appl. No.: 293,157

[22] Filed: Jan. 3, 1989

[51] Int. Cl.[4] ..... F42C 19/08

[52] U.S. Cl. ..... 102/201; 102/202

[58] Field of Search ..... 102/201, 202; 60/256, 60/39.823

[56] References Cited

U.S. PATENT DOCUMENTS

| | | | |
|---|---|---|---|
| 3,362,329 | 1/1968 | Epstein | 102/201 |
| 3,408,937 | 11/1968 | Lewis et al. | 102/201 |
| 3,812,783 | 5/1974 | Yang et al. | 102/201 |
| 3,911,822 | 10/1975 | Boling | 102/201 |
| 4,208,967 | 6/1980 | Betts | 102/28 EB |
| 4,391,195 | 7/1983 | Shann | 102/201 |
| 4,576,094 | 3/1986 | Meador | 102/202.12 |

OTHER PUBLICATIONS

Kessler et al, NASA, Technical Report 32-1474, The Detoration of Explosives Using Pulsed Laser Systems as a Stimulus, Oct. 1972.

Menichelli et al, NASA Technical Report 32-1474, Sensitivity of Explosives to Laser Energy, Apr. 30, 1970.

*Primary Examiner*—Charles T. Jordan

*Attorney, Agent, or Firm*—Freddie M. Bush; James T. Deaton

[57] ABSTRACT

A self consumable initiator is comprised of a consumable material selected from pyrotechnics, propellants, exothermic alloys, and primary explosive compositions, and one or more lengths of a fiber optic material in physical contact with or embedded in the consumable material. Uniform density of laser energy is transmitted through the fiber optic material to the consumable material in sufficient amount to stimulate the consumable material to its respective ignition point. The consumable material self consumes as it serves to ignite a larger quantity of material such a solid propellant grain. The consumable material is in the form of pellets powders, or castable shapes. When installed in a rocket motor case, the self consumable initiator is bonded or installed as a castable pyrotechnic which conforms to the contour of the front end of a solid rocket motor case. Subsequently, a solid propellant grain is bonded or cast in place in intimate contact with the initiator. After being stimulated to its ignition point with laser energy the consumable material serves to ignite the solid propellant grain. The consumable material is in the form of pellets, powders, or castable shapes. When installed in a rocket motor the self consumable initiator is bonded or installed as a castable pyrotechnic which conforms to the contour of the front end of a solid rocket motor case. Subsequently, a solid propellant grain is bonded or cast in place in intimate contact with the initiator. After being stimulated to its ignition point with laser energy the consumable material serves to ignite the solid propellant grain.

5 Claims, 1 Drawing Sheet

SELF CONSUMABLE INITIATOR

DEDICATORY CLAUSE

The invention described herein may be manufactured, used and licensed by or for the Government for governmental purposes without the payment to me of any royalties thereon.

BACKGROUND OF THE INVENTION

Initiators are generally in the form of a sealed container for containing a pyrotechnical material. For electrical firing the container has lead wires extending from the initiator to an electrical power source. The internal design can include an exploding bridge wire (EBW) or other well established combinations for achieving ignition of a pyrotechnic material which serves as an initiator for a larger quantity of propellent or explosives. Various modifications to the squib have included safety measures to prevent premature firing, delay techniques including devices to control the precise time to initiate the firing, and specific design required for the environment of use including the size, location, and means for mounting the initiator or squib for igniting a rocket motor or similar combination to provide propulsion energy or hot gas supply for multi-purposes or uses.

Other techniques for achieving rapid ignition or detonation have included the use of fuses that transforms mechanical vibrations into electrical energy. Such fuses contain barium titanate as a piezoelectric material.

Propulsion engineers have faced other design problems which have necessitated the prevention of propellant grain damage as a result of fragmentation of the initiator case or hardware components. Also, in shoulder fired rocket motors it is essential that no debris from the igniter case of the initiator damages the grain or plugs the nozzle. U.S. Pat. No. 4,576,094 issued on Mar. 18, 1986 to Jacqueline C. Meador and assigned to The United States of America as represented by the Secretary of the Army, Washington, D.C. discloses expandable polystyrene plastic ignition containers which solve the problem of nozzle plugging and propellant grain damage. The yield of light weight particles from the disintegrated cases are discharged out of a shoulder fired rocket motor without inflicting damage to the propellant grain or causing plugging of the nozzle during operation.

An additional improvement to initiators would be an initiator that doesn't require a containment case, but which relates to a technique wherein the initiator is self consumable after being ignited.

Therefore, an object of this invention is to provide a self consumable initiator system which employs laser energy directed through a fiber optic material to ignite a propellant grain or explosive material.

SUMMARY OF THE INVENTION

The initiators of this invention comprise a consumable material selected from pyrotechnics, propellants and exothermic alloys which when stimulated by laser energy to their respective ignition points will self consume. The initiators are independent of any other heat source for their consumability.

The materials which are self consumable after reaching their ignition point are in the form of pellets or powders and are selected from boron/potassium nitrate, aluminum/potassium perchlorate, propellant, and Pyrofuze. Pyrofuze is a bimetallic composite selected from palladium and aluminum, platinum and aluminum, and ruthernuim-palladium alloy and aluminum and will achieve the desired results since the energy to ignite the material is supplied through a light pipe which is a fiber optic material employed to transmit uniform density of laser energy to the easily ignitable material.

The various embodiments can vary in size from a few thousandths; e.g., 0.050"×0.050" to an inch or larger. The type of the fiber optic material can be embedded as a single or as multiple elements in a pyrotechnic pellet, in contact with loose pyrotechnic material, or bonded to a rocket motor case as a castable pyrotechnic having multiple fiber optics embedded therein and conforming to the contour of a rocket motor case at the front end. The multiple fiber optic is the only non consumable material since the initiator and propellant material are completely consumable.

DESCRIPTION OF THE PREFERRED EMBODIMENTS

The self consumable initiator is comprised of a material selected from pyrotechnics, propellants, or exothermic alloys which when stimulated to its ignition point will self consume. The selected consumable materials are selected from boron/potassium nitrate, aluminum/potassium perchlorate, propellant, and pyrofuze.

Figure 1:
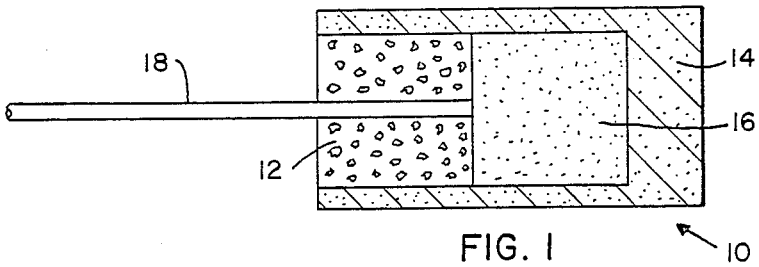
FIGS. 1 and 2 depict a fiber optic in contact with loose pyrotechnic material and wherein the tip of fiber optic is embedded in a pyrotechnic pellet, respectively.

In further reference to the Figures of the Drawing, FIG. 1 depicts a consumable initiator 10 which comprises a first consumable material 12 selected from the group of consumable materials consisting of boron/potassium nitrate pellets, aluminum/potassium perchlorate pellets, pyrofuze, and solid propellant compositions, a second consumable material 14 comprised of the materials specified for first consumable material 12, and a third consumable material 16 comprised of boron/potassium nitrate powder, aluminum/potassium perchlorate powder, solid propellant composition, pyrofuze, or other pyrotechnic mixes compatable with boron/potassium nitrate and aluminum potassium perchlorate.

A light pipe or fiber optic 18 which serves to conduct laser energy of a uniform energy density from a laser source (not shown) is shown in intimate contact with the third consumable material 16. Any combination of consumable materials 12, 14 and 16 will work; however, the powdered form which is pressed in the form of a pellet with the fiber optic tip embedded in the pellet is shown in greater detail in FIG. 2. The uniform energy density from a laser source is achieved by a typical converter in the laser art wherein a diffusion lens is placed across the output beam from a laser source, and the output laser light is then subsequently focused by a condensing lens to a parallel state to yield uniform energy density. The typical converter is illustrated in FIG. 3 and described hereinbelow. Although an energy loss from the laser source takes place, there is still enough energy at the terminus for conducting this uniform energy distribution output through a fiber optic material to achieve ignition of the pyrotechnics in accordance with this invention.

Figure 2:
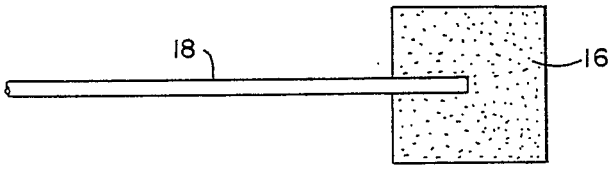
Figure 3:
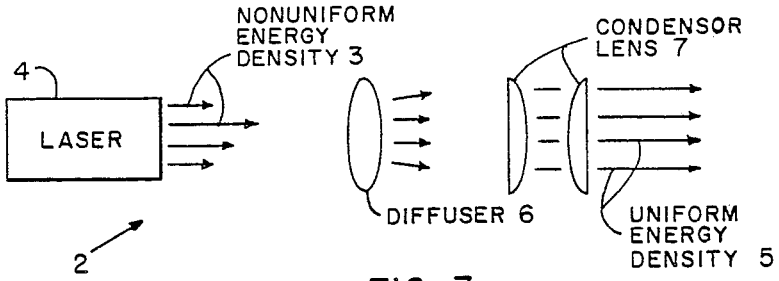
FIG. 3 depicts a schematic view of a typical convertor for the conversion of nonuniform energy density as further illustrated in FIG. 4 and FIG. 5.

FIG. 2 depicts a larger element 16 shown in FIG. 1 with the tip of fiber optic element 18 embedded therein.

FIG. 3 depicts a typical convertor 2 for conversion of nonuniform energy density 3 from a laser source 4 to a uniform energy density 5 by placing a diffuser 6 across the laser output beam 3 of nonuniform energy density from the laser source and subsequently focusing by condensing lens 7 to a parallel state to yield uniform energy density 5.

Figure 4:
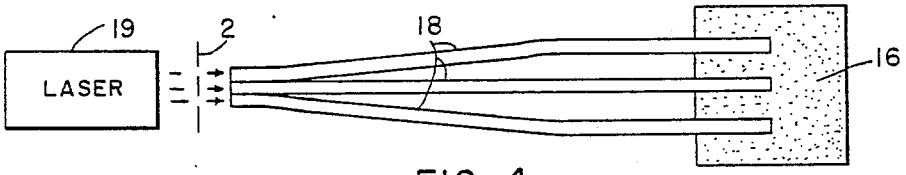
FIG. 4 depicts a schematic view of multiple fiber optics embedded in a large consumable pyrotechnic pellet which is ignited through the multiple fiber optics by a laser source.

FIG. 4 depicts a larger element 16 shown in FIG. 1 with the tips of a plurality of fiber optic elements 18 embedded therein. A laser source 19 is shown which in operation furnishes the power for transmitting a uniform energy density 5 in accordance with the typical convertor illustrated in FIG. 3 through the fiber optics 18 to stimulate element 16 to its ignition point. When the combinations of FIG. 2 or FIG. 4 are in combination as illustrated in FIG. 1, the consumable material 16 (ignited by the laser energy) will ignite consumable materials 12 and 14.

Figure 5:
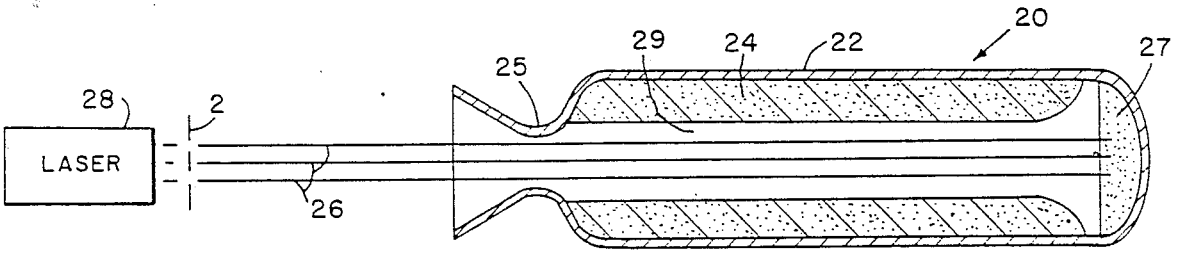
FIG. 5 depicts a schematic view of a consumable squib which is ignited from laser energy transmitted through the fiber optics to the consumable squib.

FIG. 5 depicts in diagrammatic form a self consumable initiator in combination with a rocket motor system 20 with its illustrated components. Rocket motor system 20 includes the rocket motor case 22 with a propellant grain 24 bonded therein.

A nozzle 25 is shown installed at the aft end of the rocket motor. A pyrotechnic 27 is shown bonded to the inside surface of rocket motor case 22 at the front end. At the aft end of the rocket motor case a plurality of fiber optics 26 extend from a uniform energy density 5 converted in accordance with a typical convertor 2 as shown in FIG. 3 and as further shown in FIG. 5 from a laser source 28 through the perforated opening 29 into and embedded in a castable pyrotechnic 27 conforming to the contour of rocket motor case 22 front end portion.

For convenience of the user, the pyrotechnic materials disclosed in my U.S. Pat. No. 4,208,967, issued June 24, 1980, and assigned to the United States of America as represented by the Secretary of the Army, Washington, D.C., can be employed as the self consumable material in combination with fiber optics to conduct laser energy to the consumable material. The pyrotechnic materials as disclosed in the above patent are grouped by the following pyrotechnic groups A-C listed below.

Pyrotechnic group A-Metal Fuel-Oxidizers

1. Mag-Teflon (Polytetrafluroethylene)
   60% magnesium
   40% Teflon
2. Boron-Potassium Nitrate
   Boron: 23.7±2%
   Potassium Nitrate: 70.7+2%
   Binder: 5.6
3. Zirconium-Potassium Perchlorate

| | | |
|---|---|---|
| Zr | 45% | 10 Microns |
| $KClO_4$ | 55% $KClO_4$ | 6 to 17 Microns |

4. Aluminum flake (17–44 microns) 45% - potassium perchlorate (6 to 17 microns) 55%.

Pyrotechnic group B-Primary Explosives

1. Lead Azide
2. Lead Styphnate
3. Etc.

Pyrotechnic group C-Propellants

1. Double-Base (any kind)
2. Single-Base (any kind)
3. Composite (any kind)
4. Black Powders
5. Etc.

I claim:

1. A self consumable initiator including a consumable material in combination with a fiber optic material which functions to conduct laser energy from a laser source to said consumable material to thereby stimulate said consumable material to its ignition point and thereafter said consumable material self consumes, said self consumable initiator comprising:

(i) A consumable composition selected from the group of easily - ignitable compositions specified under pyrotechnic groups A-C as follows:

Pyrotechnic group A: metal fuel-oxidizer, composition 1: magnesium 60% by weight and polytetrafluorethylene 40% by weight, composition 2: boron 23.7%±2% by weight, potassium nitrate 70.7%±2% by weight, and binder 5.6% by weight; composition 3: zirconium 10 microns particle size 45% by weight and potassium perchlorate 6 to 17 microns particle size 55% by weight; and composition 4: aluminum flake 17 to 44 microns particle size 45% by weight and potassium perchlorate 6 to 17 microns particle size 55% by weight;

Pyrotechnic group B: primary explosive, composition 1: lead acids; and composition 2: lead styphnate; Pyrotechnic group C; propellants, composition 1: double-base propellants; composition 2: single base propellants, composition 3: composite propellants; and composition 4: black powders; and, (ii) One or more lengths of a fiber optic material in contact with said consumable composition, said one or more lengths of a fiber optic material adapted for receiving laser energy of a uniform energy density from a laser source whereby said consumable composition is stimulated to its ignition point and thereafter self consumes.

2. The self consumable initiator as defined in claim 1 wherein said consumable composition is in the form of a pellet and wherein said fiber optic has a tip portion embedded in said pellet.

3. The self consumable initiator as defined in claim 1 wherein said consumable composition is employed as a plurality of compositions selected from said pyrotechnic group, and wherein said plurality of compositions from said pyrotechnic group are in physical contact with one another and wherein at lease one of said consumable compositions is in contact with a tip portion of one or more of said fiber optic material.

4. The self consumable initiator as defined in claim 3 wherein said consumable composition is in the form of a pellet and wherein the tip portion of a plurality of said fiber optic material is embedded in said pellet.

5. The self consumable initiator as defined in claim 1 wherein said self consumable initiator is bonded to the head end portion of a rocket motor case and a solid propellant grain is cast or installed in physical contact with said self consumable initiator which functions as an igniter for said propellant grain when said consumable composition is stimulated to its ignition point, self consumes, and ignites said solid propellant grain.

* * * * *